US005999156A

United States Patent [19]

Shimada et al.

[11] Patent Number: 5,999,156

[45] Date of Patent: Dec. 7, 1999

[54] MATRIX ELECTRODE STRUCTURAL DISPLAY ELEMENT DRIVING UNIT

[75] Inventors: Nobushige Shimada, Nara; Koichi Kajimoto, Tenri, both of Japan

[73] Assignee: Sharp Kabushiki Kaisha, Osaka, Japan

[21] Appl. No.: 08/656,015

[22] Filed: May 24, 1996

[30] Foreign Application Priority Data

Jun. 15, 1995 [JP] Japan ..... 7-149163

[51] Int. Cl.[6] ..... G09G 3/36

[52] U.S. Cl. ..... 345/94; 345/98; 345/100; 345/96

[58] Field of Search ..... 345/94–96, 208–210, 345/98, 100

[56] References Cited

U.S. PATENT DOCUMENTS 5,010,326 4/1991 Yamazaki et al. ..... 345/94

5,066,945 11/1991 Kano et al. ..... 345/94

5,214,417 5/1993 Yamazaki et al. ..... 345/95

5,343,217 8/1994 Kim ..... 345/95

*Primary Examiner*—Richard A. Hjerpe

*Assistant Examiner*—Francis Nguyen

[57] ABSTRACT

A matrix electrode structural display element driving unit is provided with a display panel in which electrodes are arranged in a matrix pattern, and a signal electrode driving circuit and a scanning electrode driving circuit for driving the display panel. A latch pulse signal LPX to be inputted to the signal electrode driving circuit and a latch pulse signal LPY to be inputted to the scanning electrode driving circuit are used as signals with different waveforms. Since a conventional general driving IC is used, a unit, where a level of an applied voltage to a display element is changed twice during one selecting period, can be obtained at a low price.

9 Claims, 8 Drawing Sheets

FIG. 3

SIGNAL ELECTRODE SIDE LIQUID CRYSTAL DRIVING IC FUNCTION

| Input signal | | Output voltage of liguid crystal driving IC |
|---|---|---|
| Switching signal FR | Latch data | |
| L | L | V 2 |
| L | H | V 0 |
| H | L | V 3 |
| H | H | V 5 |

FIG. 4

SCANNING ELECTRODE SIDE LIQUID CRYSTAL DRIVING IC FUNCTION

| Input signal | | Output voltage of liguid crystal driving IC |
|---|---|---|
| Switching signal FR | Shift register data | |
| L | L | V 1 |
| L | H | V 5 |
| H | L | V 4 |
| H | H | V 0 |

MATRIX ELECTRODE STRUCTURAL DISPLAY ELEMENT DRIVING UNIT

FIELD OF THE INVENTION

The present invention mainly relates to a matrix electrode structural display element driving unit for driving a display element of a matrix electrode structural display by means of multiplex driving method, in particular, relates to a matrix electrode structural display element driving unit for changing a level of a voltage to be applied to the matrix electrode structural display element twice or more during one selecting period.

BACKGROUND OF THE INVENTION

As shown in FIG. 7, for example, a general liquid crystal display element driving unit, which drives a liquid crystal display element as a matrix electrode structural display element by means of multiplex driving method, is arranged so as to have a display panel 101, where signal electrodes $X_1$ through $X_M$ and scanning electrodes $Y_1$ through $Y_N$ are disposed in a matrix-like pattern and liquid crystal display elements are respectively connected to intersection portions of the signal electrodes $X_1$ through $X_M$ and the scanning electrodes $Y_1$ through $Y_N$, a signal electrode driving circuit 102 for driving the signal electrodes $X_1$ through $X_M$ and a scanning electrode driving circuit 103 for driving the scanning electrodes $Y_1$ through $Y_N$.

Signal electrode side liquid crystal driving ICs (Integrated Circuit) 105, which apply a prescribed voltage according to display to the signal electrodes $X_1$ through $X_M$, are provided to a signal electrode side substrate 104 of the signal electrode driving circuit 102, and scanning electrode side liquid crystal driving ICs 107, which line-sequentially apply a fixed voltage to the scanning electrodes $Y_1$ through $Y_N$ are provided to a scanning electrode side substrate 106 of the scanning electrode driving circuit 103. A liquid crystal display element applied voltage, which is voltage difference between liquid crystal driving voltages outputted from the signal electrode side liquid crystal driving ICs 105 and the scanning electrode side liquid crystal driving ICs 107, is applied to each liquid crystal display element of the display panel 101.

In other words, in the signal electrode driving circuit 102, when input signals (LP, SCLK, FR and Data), logical circuit voltages (VCC and GND) and liquid crystal driving voltages (V0, V2, V3 and V5) are inputted from a control section 110 to the signal electrode side liquid crystal driving ICs 105 through the signal electrode side substrate 104 as an external input interface, one of the four kinds of the above liquid crystal driving voltages is applied to the signal electrodes X1 through XM from the signal electrode side liquid crystal driving IC 105.

In addition, in the scanning electrode driving circuit 103, when input signals (FP, LP and FR), logical circuit voltages (VCC and GND) and liquid crystal driving voltages (V0, V1, V4 and V5) are inputted from the control section, not shown, to the scanning electrode side liquid crystal driving ICs 107 through the scanning electrode side substrate 106 as an external input interface, one of the two kinds of the liquid crystal driving voltages for selection in the four kinds of the liquid crystal driving voltages is selectively applied to selected lines of the scanning electrodes $Y_1$ through $Y_N$, and one of the two kinds of the liquid crystal driving voltages for non-selection is selectively applied to non-selected lines.

The signal electrode side liquid crystal driving IC 105 has functions, for example, shown in FIG. 3 which is an explanatory drawing of the present invention. In other words, in the signal electrode side liquid crystal driving IC 105, after the inputted Data signal are successively stored from a position according to the right or left end of the display panel 101 at timing shown in FIG. 8, namely, timing that the inputted Data signal is synchronized with the shift clock signal SCLK after the latch pulse signal LP is changed from High level (ie. "H") to Low level (ie. "L"). When the latch pulse signal LP is again changed from "H" to "L", the Data signal stored in the signal electrode side liquid crystal driving IC 105 is latched. Then, the liquid crystal driving voltages are selectively outputted according to the combination of the latched Data signal (ie. latched Data) and the switching signal FR which is an input signal to be inputted to the signal electrode driving circuit 102.

In addition, the scanning electrode side liquid crystal driving IC 107 has functions shown in FIG. 4 which is an explanatory drawing of the present invention, for example. In other words, the scanning electrode side liquid crystal driving IC 107 selectively outputs the liquid crystal driving voltage according to the combination of the switching signal FR to be inputted and the Data signal from the shift register, not shown, provided to the scanning electrode side liquid crystal driving IC 107 (ie. shift register Data). When the frame pulse signal FP to be inputted to the scanning electrode side liquid crystal driving IC 107 is at "H" and the latch pulse signal LP is changed from "H" to "L", only the shift register Data on the first line are at "H" and the shift register Data on the other lines are at "L". Meanwhile, when the frame pulse signal FP is at "L" and the latch pulse signal LP is changed from "H" to "L", in the case where the shift register Data on the (m−1)-numbered line are at "H" before the changing, only the shift register Data on the m-numbered line are at "H" and the shift register Data on the other lines are at "L" after the changing.

The latch pulse signal LP to be inputted to the signal electrode driving circuit 102 is the same as the latch pulse signal LP to be inputted to the scanning electrode driving circuit 103, and the switching signals FR to be inputted to the signal electrode driving circuit 102 is the same as the switching signal FR to be inputted to the scanning electrode driving circuit 103.

The following describes a relationship between a liquid crystal applied voltage waveform observed from one picture element $X_j$-$Y_i$ in the display panel 101 shown in FIG. 7 and the input signal from the external interface on reference to a timing chart of FIG. 9. Here, the waveforms on the right and left sides of the drawing show examples of two different kinds of waveforms. Moreover, the timing chart of FIG. 8 and the upper timing chart of FIG. 9 are the same.

The drawing shows examples of waveforms of, from the above, an external interface input signal, the latched data which are obtained by latching the external interface inputted signal by the latch pulse signal LP, namely, the $X_j$ line Data. Hereafter, the drawing shows accomplished waveforms of output voltages from the signal electrode side liquid crystal driving IC 105 and the scanning electrode side liquid crystal driving IC 107 according to the above examples of the waveforms and in the case where the line $Y_i$ is selected as the line of the scanning electrode, and a waveform of an applied voltage to the one picture element $X_j$-$Y_i$ on the display panel 101 (waveform of the matrix electrode structural display element applied voltage) which is the final result of the waveforms of the output voltages.

However, as shown in FIG. 9, according to the waveform of the applied voltage to the one picture element $X_j$-$Y_i$ on the display panel 101, in the above conventional liquid crystal display element driving unit, a change in the level of the voltage which can be applied to one line during one selecting period is limited to once. The selecting period is a period of time for determining by a level of a voltage to be applied as to whether a liquid crystal display element on a certain line is made in an "ON state" or "OFF state", and the selecting period for one line is obtained such that one frame pulse signal FP period which is a time for displaying one image is divided by a number of latch pulse signals LP during one frame pulse signal FP period (a scanning electrode-side latch pulse signal LPY instead of the latch pulse signal LP in an arrangement of the present invention mentioned later).

Incidentally, in order to switch the level of the voltage, which is changed according to the Data signal, twice or more during one selecting period, it is necessary to arrange the signal electrode side liquid crystal driving IC so that it is capable of changing contents of the latched data, which can be primarily changed only when the latch pulse signal LP is changed from "H" to "L", at arbitrary timing by inputting not only the input control signals (Data signal, etc.) shown in FIG. 7 but also another control signal from the outside.

Therefore, since development of a new driving IC is required, the conventional driving ICs cannot be utilized, and since such development requires time, costs of producing units increase.

SUMMARY OF THE INVENTION

It is an object of the present invention to provide a matrix electrode structural display element driving unit, which is capable of changing a level of a voltage twice or more during one selecting period using a conventional driving IC, at a low price.

In order to attain the above object, a first matrix electrode structural display element of the present invention, which applies a voltage difference between voltages from a signal electrode group and a scanning electrode group, which are arranged in a matrix pattern, to a matrix electrode structural display element according to a data signal so as to drive the matrix electrode structural display element, has a signal electrode driving circuit for selecting one voltage from four voltages according to the data signal and a switching signal so as to apply the voltage as a signal electrode voltage to each signal electrode, and a scanning electrode driving circuit for selecting one voltage from two voltages for selection according to the switching signal and a selection signal, which represents which line should be selected, so as to apply the voltage to the scanning electrode, which corresponds to the selected line, and for selecting one voltage of two voltages for a non-selected line so as to apply the voltage as a scanning electrode voltage to the scanning electrodes, which corresponds to the non-selected line. The matrix electrode structural display element driving unit is arranged so that wherein a level of the voltage to be applied to the matrix electrode structural display element is changed twice or more during fixed one selecting period by combining the signal electrode driving circuit with the scanning electrode driving circuit.

In accordance with the above arrangement, since the level of the voltage to be applied to the matrix electrode structural display element is changed twice or more during one selecting period, it is not necessary to additionally provide a signal electrode driving circuit, which is capable of changing an applied voltage at desired timing according to a control signal inputted from the outside, in order to change the applied voltage to the liquid crystal display element twice or more during one selecting period. As a result, since a conventional signal electrode driving circuit can be used, the matrix electrode structural display element driving unit, which is capable of changing a voltage level twice or more during one selecting period, can be provided at a low price. In other words, while the conventional signal electrode driving circuit is used, the level of the applied voltage to the display element can be changed twice or more during one selecting period, thereby making it possible to achieve the simplification and the lower price of the unit.

A second matrix electrode structural display element driving unit according to the first matrix electrode structural display element driving unit is characterized in that the switching signal is a signal which is reversed at a divided point at which the one selecting period is divided into two, and that in the signal electrode driving circuit, a reversed signal of the data signal is used for selecting the voltage during the first half of the one selecting period and the data signal is used for selecting the voltage during the latter half of the one selecting period.

In accordance with the above arrangement, one selecting period is divided into two, and the switching signal, which is reversed at the divided point of the selecting period is inputted to the signal electrode driving circuit and the scanning electrode driving circuit. At the same time, the reversed signal of the data signal, which is inputted during the latter half of one selecting period, is inputted to the signal electrode driving circuit during the first half of the divided selecting period, and the data signal to be primarily displayed is inputted thereto during the latter half of the divided selecting period. As a result, one selecting period is divided into two at its center portion, and waveforms of voltages can be obtained corresponding to the combination of both the data signal, which is primarily inputted during the latter half of the divided selecting period and is reversed during the first half of the divided selecting period, and the switching signal which is reversed during the following the latter half of the divided selecting period. In other words, when one selecting period is divided into two at its center portion and the reversed signal of the data signal, which is primarily inputted during the latter half of the divided selecting period is inputted during the first half of the divided selecting period, it is possible to obtain two kinds of voltage waveforms, namely, a voltage waveform corresponding to a reversed signal of the data signal and the switching signal during the first half of the one selecting period and a voltage waveform corresponding to the data signal and the reversed signal of the switching signal during the latter half of one selecting period.

A third matrix electrode structural display element driving unit according to the first matrix electrode structural display element driving unit is characterized in that the switching signal is a signal which is reversed at divided points at which the one selecting period is divided plurally and that in the signal electrode driving circuit, a high-level signal is used as the data signal for selecting the voltage during a first period of the selecting period, and the data signal is used for selecting the voltage during the remaining period of the selecting period.

In accordance with the above arrangement, if the level of the voltage is changed twice during one selecting period, for example, the one selecting period is divided into two, the switching signal to be reversed at the divided points of the one selecting period is inputted to the signal electrode driving circuit and the scanning electrode driving circuit. At the same time, a high-level data signal is inputted to the signal electrode driving circuit during the first half of the divided period, and the data signal to be primarily displayed is inputted thereto during the latter half of the divided period. As a result, one selecting period is divided into two at its center portion, and an output voltage waveform corresponding to an "ON" signal as a high-level signal, for example, can be obtained during the first half of the divided period. In other words, if the level of the voltage is changed twice during one selecting period, for example, when one selecting period is divided into two at its center portion and the output voltage waveform corresponding to the "ON" signal as the high-level signal, for example, is obtained during the first half of the divided period, it is possible to obtain two kinds of the voltage waveforms, namely a voltage waveform corresponding to the data signal and the switching signal during the first half of the one selecting period and a voltage waveform corresponding to the data signal and the reversed signal of the switching signal during the latter half of the selecting period.

For fuller understanding of the nature and advantages of the invention, reference should be made to the ensuing detailed description taken in conjunction with the accompanying drawings.

BRIEF DESCRIPTION OF THE DRAWINGS

FIG. 3 is a table which shows functions of a signal electrode side liquid crystal driving IC provided to the liquid crystal display element driving unit shown in FIG. 2.

FIG. 4 is a table which shows functions of a scanning electrode side liquid crystal driving IC provided to the liquid crystal driving unit shown in FIG. 2.

DETAILED DESCRIPTION OF THE PREFERRED EMBODIMENTS

EMBODIMENT 1

The following describes one embodiment of the present invention on reference to FIGS. 1 through 5. The present embodiment describes a liquid crystal display element driving unit as a matrix electrode structural display element driving unit, which drives liquid crystal display elements by means of multiplex driving method.

Figure 2:
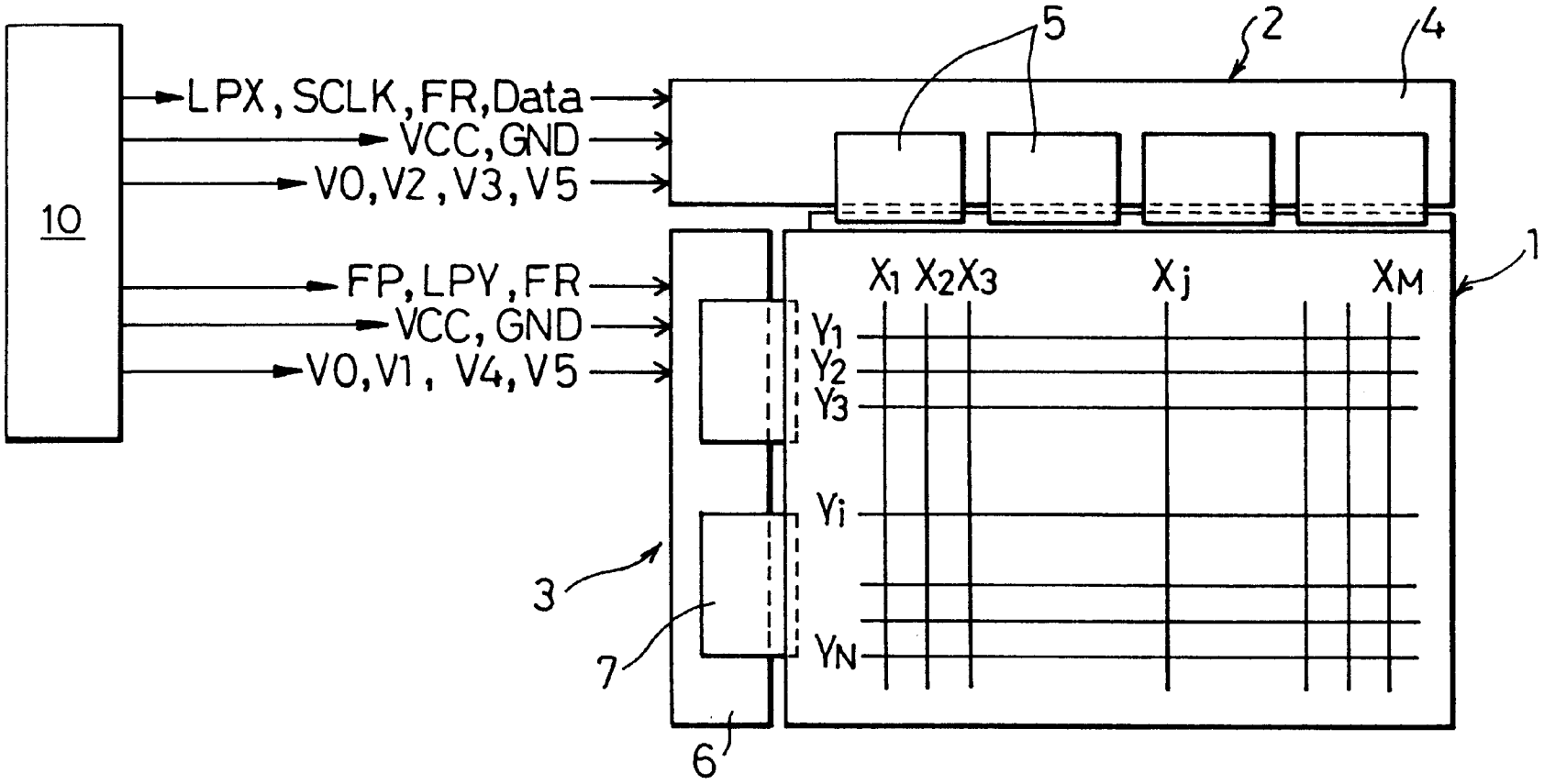
FIG. 2 is a schematic constitutional drawing of the liquid crystal display element driving unit.

As shown in FIG. 2, the liquid crystal display element driving unit of the present embodiment is composed of a display panel (matrix electrode structural display) 1, where signal electrodes $X_1$ through $X_M$ and scanning electrodes $Y_1$ through $Y_N$ are arranged in a matrix pattern, a signal electrode driving circuit 2 for driving the signal electrodes $X_1$ through $X_M$ and a scanning electrode driving circuit 3 for driving the scanning electrodes $Y_1$ through $Y_N$.

On the display panel 1, liquid crystal display elements as the matrix electrode structural display elements, not shown, are connected to intersection portions of the signal electrodes $X_1$ through $X_M$ and the scanning electrodes $Y_1$ through $Y_N$, or liquid crystal elements as the matrix electrode structural display elements, not shown, and two-terminal elements, such as MIM (Metal Insulator Metal) elements are connected thereto in a series.

In addition, signal electrode side liquid crystal driving ICs (Integrated Circuit) 5 for applying a prescribed voltage according to display to the signal electrodes $X_1$ through $X_M$ are provided to a signal electrode side substrate 4 as an external interface of the signal electrode driving circuit 2, and scanning electrode side liquid crystal driving ICs 7 for applying a prescribed voltage line-sequentially to the scanning electrodes $Y_1$ through $Y_N$ are provided to a scanning electrode side substrate 6 as an external interface of the scanning electrode driving circuit 3. A liquid crystal display element applied voltage (matrix electrode structural display element applied voltage), which is a signal difference between the liquid crystal driving voltages outputted from the signal electrode side liquid crystal driving ICs 5 and the scanning electrode side liquid crystal driving ICs 7, is applied to each liquid crystal display element of the display panel 1.

In addition, in the signal electrode driving circuit 2, input signals (LPX, SCLK, FR and Data), voltages for a logical circuit (VCC and GND) and liquid crystal driving voltage (V0, V2, V3 and V5) which are inputted from a control section 10 are inputted to the signal electrode side liquid crystal driving ICs 5 through the signal electrode substrate 4, and one of the above four kinds of the liquid crystal driving voltages is applied to the signal electrodes $X_1$ through $X_M$ from the signal electrode side liquid crystal driving ICs 5.

In addition, in the scanning electrode driving circuit 3, input signals (LPY, FP and FR), voltages for a logical circuit (VCC and GND) and liquid crystal driving voltages (V0, V1, V4 and V5), which are inputted from the control section, not shown, are inputted to the scanning electrode side liquid crystal driving ICs 7 through the scanning electrode side substrate 6. One of two kinds of the liquid crystal driving voltages for selected lines in the above four kinds of the liquid crystal driving voltages is selectively applied from the scanning electrode side liquid crystal driving ICs 7 to a line selected from the scanning electrodes $Y_1$ through $Y_N$, and one of the two kinds of the liquid crystal driving voltages for non-selected lines is selectively applied to a non-selected line.

The signal electrode side liquid crystal driving ICs 5 is generally composed of a latch circuit, etc. including a shift register, an analog switch, a D-type flip flop, etc., not shown, and as shown in FIG. 3, for example, it has a function in selectively outputting output voltages of the four kinds of output voltages from the liquid crystal driving ICs according to a combination of a switching signal FR and data (latched Data) which were obtained such that a Data signal as the input signal has been latched at timing of a latch pulse signal LP in the signal electrode side liquid crystal driving ICs 5. For example, if the switching signal FR is at "L" and the latched Data are at "L", the liquid crystal driving voltage V2 is selected as the output voltage from the signal electrode side liquid crystal driving IC 5.

In addition, the scanning electrode side liquid crystal driving IC 7 is composed of a shift register, an analog switch, etc., and as shown in FIG. 4, for example, it has a function in selectively outputting one of output voltages of four kinds of output voltages from the liquid crystal driving IC according to a combination of the switching signal FR and the shift register Data outputted from the shift register in the scanning electrode driving circuit 3. For example, if the switching signal FR is at "L" and the shift register Data are at "L", the liquid crystal driving voltage V1 is selected as the output voltage from the scanning electrode side liquid crystal driving IC 7.

Therefore, the latch pulse signal LPX and the latch pulse signal LPY which respectively have different waveforms are inputted to the signal electrode driving circuit 2 and the scanning electrode driving circuit 3. Moreover, the switching signal FR of the signal electrode driving circuit 2 is the same as the switching signal FR of the scanning electrode driving circuit 3.

Figure 5:
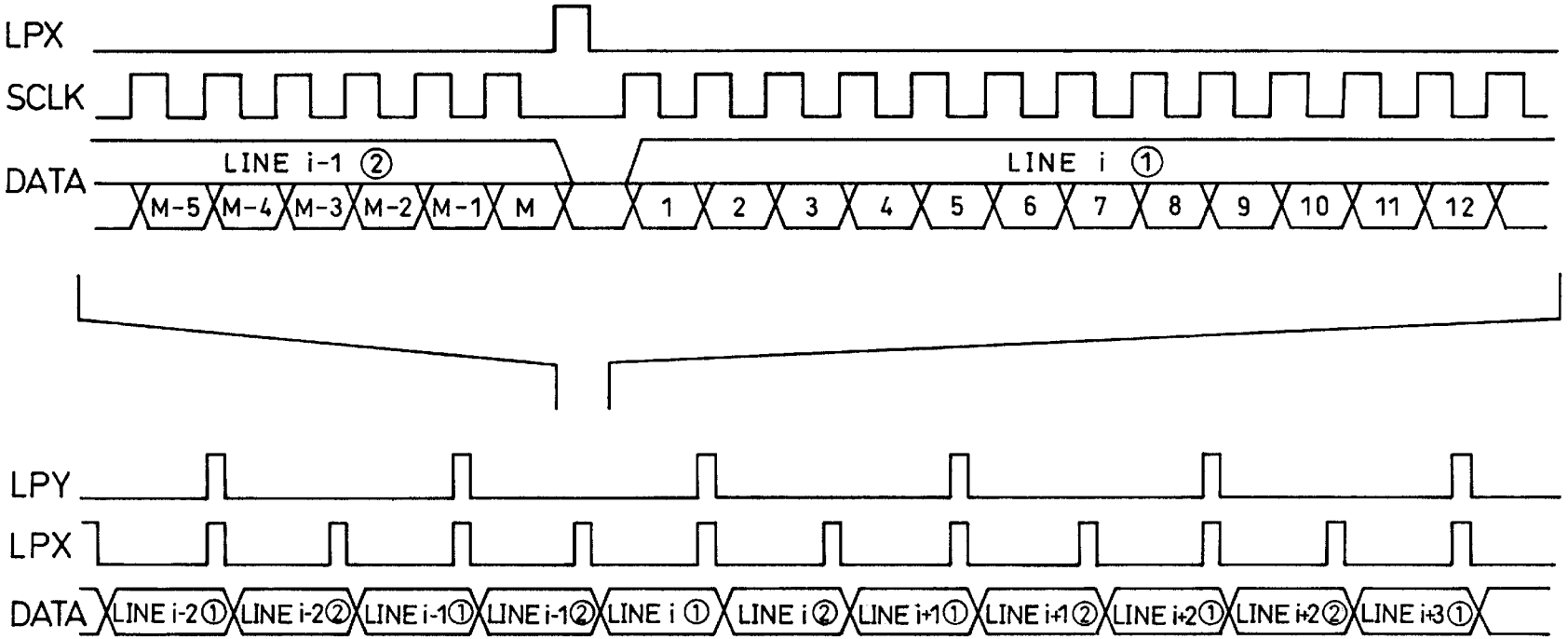
FIG. 5 is a timing chart of a control signal to be inputted to the liquid crystal display element driving unit shown in FIG. 2.

The following describes a relationship of signals to be inputted to the liquid crystal display element driving unit having the above arrangement on reference to FIG. 5. Here, the present embodiment describes the case where the level of a voltage, which can be applied to one line, is changed twice during one selecting period. Moreover, if the level of the voltage to be applied to one line is changed n-times ($n \geqq 2$) during one selecting period, an operating frequency of a shift clock signal SCLK should be set so as to be "n" times as high as the case described in the prior arts. This is in order to make refresh rates (frame frequency) for one screen display in the prior art and in the present invention same.

In FIG. 5, the Data designate a data signal to be written to the liquid crystal display element of the display panel 1, the LPX designates a latch pulse signal for creating selecting period in the signal electrode driving circuit 2, and the LPY designates a latch pulse signal for creating selecting period in the scanning electrode driving circuit 3. The latch pulse signal LPX and the latch pulse signal LPY respectively show different waveforms.

In addition, the SCLK designates a shift clock signal for successively shifting the Data according to the signal electrode $X_1$ through $X_M$, and its waveform is such that data for one line of the Data are divided into two during 1 selecting period so as to be outputted to the signal electrode driving circuit 2.

Therefore, the Data (on line "i" ①), which should be first written to the line "i", are transmitted to the signal electrode side liquid crystal driving IC 5 (FIG. 2) from the signal electrode side substrate 4 (FIG. 2) as the external interface at timing of the shift clock signal SCLK. Thereafter, the latch pulse signal LPX of the signal electrode side liquid crystal driving IC 5 and the latch pulse signal LPY of the scanning electrode side liquid crystal driving IC 7 are changed from "H" to "L".

In the signal electrode side liquid crystal driving IC 5, the line "i" ① of the Data is latched (D-latched) therein by the D-type flip flop as a latch circuit according to the latch pulse signal LPX. As shown in FIG. 3, a liquid crystal driving voltage is applied to the signal electrodes $X_1$ through $X_{1/M}$ which is half of the signal electrodes on one line by a combination of the Data which have been latched (latched Data) and the switching signal FR.

In addition, in the scanning electrode side liquid crystal driving IC 7, a next line (line "i") is selected by the latch pulse signal LPY. As shown in FIG. 4, a liquid crystal driving voltage (only line "i" is at a selecting level, and the others are at a non-selecting level) is applied to the scanning electrodes $Y_1$ through $Y_N$ according to a combination of shift register Data, which are outputted from the shift register with them synchronized with a frame pulse signal FP, and of a switching signal FR.

Next, Data (line "i" ②), which should be second written to the line "i", are transmitted from the signal electrode side substrate 4 as an external interface to the signal electrode side liquid crystal driving IC 5 (FIG. 2) at timing of a shift clock signal SCLK. Thereafter, an only latch pulse signal LPX of the signal electrode side liquid crystal driving IC 5 is changed from "H" to "L".

Here, in the signal electrode side liquid crystal driving IC 5, the line "i" ② of the Data is D-latched therein by the latch pulse signal LPX. As shown in FIG. 3, a liquid crystal driving voltage is applied to the remaining signal electrodes $X_{1/M+1}$ through $X_M$ on the line according to a combination of the latched Data and the switching signal FR, mentioned later.

At this time, the line "i" is maintained in a selecting level by the scanning electrode side liquid crystal driving IC 7.

Therefore, since the signal electrodes $X_1$ through $X_M$ are divided into the first half and the latter half of one line, namely, the line "i" ① and the line "i" ②, and the liquid crystal driving voltage is respectively applied thereto during period in which the line "i" of the data signal is selected once, different voltage levels can be obtained in the first half and the latter half of one line. Therefore, the levels of the voltages to be applied to the liquid crystal display element can be changed twice per one line during one selecting period.

Figure 1:
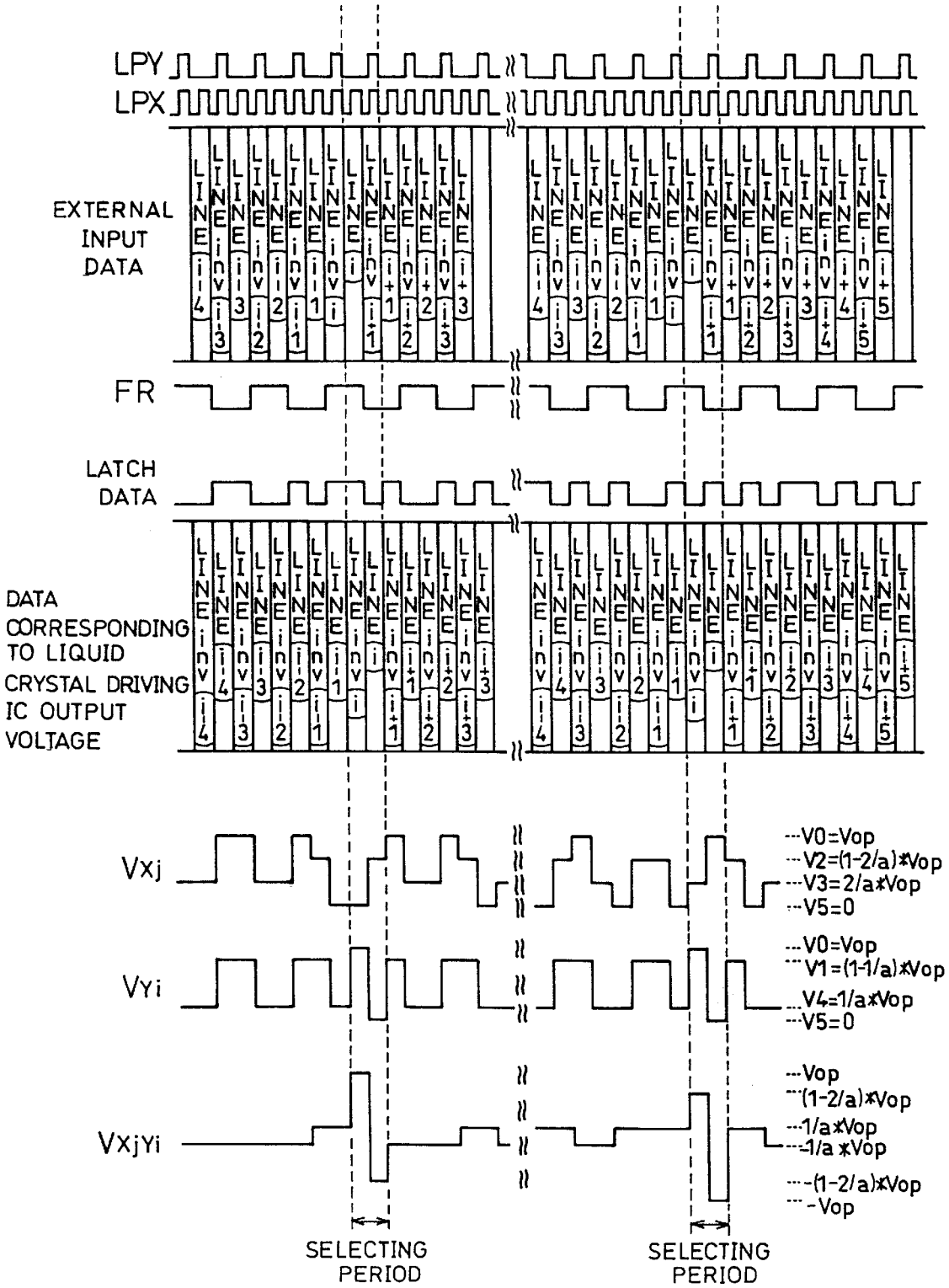
FIG. 1 is a driving timing chart in a liquid crystal display element driving unit according to one embodiment of the present invention.

Here, the following describes a relationship between a waveform of a voltage to be applied to one picture element $X_j$-$Y_i$ in the display panel 1 shown in FIG. 2 and the input signal from the external interface on reference to a timing chart of FIG. 1. Here, the waveforms on the right and left sides of the drawing show examples of two different kinds of waveforms.

The LPY, LPX and external input Data on the upper side of FIG. 1 are the same as the LPY, LPX and Data shown in FIG. 5. The external input Data show the contents of data on each line. The contents of data on each line are divided into two during one selecting period, and a data signal corresponding to the first half of the period logically shows a signal obtained by reversing the original signal contents and it is designated by "inv", and a signal corresponding to the latter half of the period shows the original signal.

In FIG. 1, FR shows a switching signal which is reversed at the dividing point of one selecting period, and the latched Data show a signal waveform of the external input Data which have been latched by the latch pulse signal LPX on the signal electrode $X_j$. Moreover, the contents of the latched Data corresponding to an output voltage of the signal electrode side liquid crystal driving IC 5 are shown in the lower part of the latched data.

In addition, $V_{Xj}$ is a signal waveform (signal electrode side applied voltage) to be applied to the signal electrodes $X_1$ through $X_M$, and it is represented by four voltages V0, V2, V3 and V5. $V_{Yi}$ is a signal waveform (scanning electrode side applied voltage) to be applied to the scanning electrodes $Y_1$ through $Y_N$, and it is represented by four voltages V0, V1, V4 and V5. $V_{XjYi}$ is a signal waveform of a difference between the signal electrode side applied voltage and the scanning electrode side applied voltage to be applied to the both ends of one picture element $X_j$-$Y_i$ (waveform of matrix electrode structural display element applied voltage), and it is represented by six voltages $V_{op}$, $(1-2/a)V_{op}$, $(1/a)V_{op}$, $-(1/a)V_{op}$, $-(1-2/a)V_{op}$ and $-V_{op}$. Here, "a" shows a constant.

The voltages V0 through V5 are, as mentioned above, six-level voltages which are required for driving liquid crystal, and the voltages $\pm V_{op}$ is a liquid crystal driving voltage for turning ON the liquid crystal display element at the selecting level. Moreover, the voltages $\pm(1-2/a)V_{op}$ are liquid crystal driving voltages for turning OFF the liquid crystal display element at the selecting level. Furthermore, the voltages $\pm(1/a)V_{op}$ are liquid crystal driving voltages at a non-selecting level. Values of the voltages $\pm V_{op}$ and the constant "a" varies with conditions of the display panel 1, such as a property of the liquid crystal display element and capacity ratio, and driving conditions, such as frame frequency and duty ratio.

Here, detailed description is given regarding the above voltages V0 through V5.

The voltage V0 is equal to $V_{op}$(V). In the signal electrode side liquid crystal driving IC 5, when the latched Data are at "H" level and the switching signal FR is at "L" level, the voltage V0 becomes a voltage to be selected for applying to each signal electrode $X_1$ through $X_M$, and when the shift register Data are at "H" level showing selection and the switching signal FR is at "H" level in the scanning electrode side liquid crystal driving IC 7, the voltage V0 becomes a voltage to be selected for applying to each scanning electrode.

The voltage V1 is equal to $(1-1/a)V_{op}$ (V). In the scanning electrode side liquid crystal driving IC 7, when the shift register Data are at "L" level showing non-selection and the switching signal FR is at "L" level, the voltage V1 becomes a voltage to be selected for applying to each scanning electrode.

The voltage V2 is equal to $(1-2/a)V_{op}$ (V). In the signal electrode side liquid crystal driving IC 5, when the latched Data are at "L" level and the switching signal FR is at "L" level, the voltage V2 becomes a voltage to be selected for applying to each signal electrode.

The voltage V3 is equal to $(2/a)V_{op}$ (V). In the signal electrode side liquid crystal driving IC 5, when the latched Data are at "L" level and the switching signal FR is at "H" level, the voltage V3 becomes a voltage to be selected for applying to each signal electrode.

The voltage V4 is equal to $(1/a)V_{op}$ (V). In the scanning electrode side liquid crystal driving IC 7, when the shift register Data are at "L" level showing non-selection and the switching signal FR is at "H" level, the voltage V4 becomes a voltage to be selected for applying to each scanning electrode.

The voltage V5 is 0(V). In the signal electrode side liquid crystal driving IC 5, when the latched Data are at "H" level and the switching signal FR is at "H" level, the voltage V5 becomes a voltage to be selected for applying to each signal electrode, and in the scanning electrode side liquid crystal driving IC 7. when the shift register Data are at "H" level showing selection and the switching signal FR is at "L" level, the voltage V5 becomes a voltage to be selected for applying to each scanning electrode.

Therefore, $V_{xj}$ is determined by the combination of the switching signal FR and the latched Data in the signal electrode side liquid crystal driving IC 5. For example, on the line (inv) i in the first half of the selecting period of the line "i", the latched Data are at "H" level, and the switching signal FR is also at "H" level. As shown in FIG. 3, the liquid crystal driving voltage is determined as V5. Moreover, on the line "i" in the latter half of the selecting period of the line "i", the latched Data are at "L" level and the switching signal FR is also at "L" level, and as shown in FIG. 3, the liquid crystal driving voltage is determined as V2.

In addition, $V_{Yi}$ is determined by the combination of the switching signal FR and the shift register Data in the scanning electrode side liquid crystal driving IC 7. For example, since on the line (inv) i in the first half of the selecting period of the line "i", the switching signal FR is at "H" level and the shift register Data are at "H" level, as shown in FIG. 4, the liquid crystal driving voltage is determined as V0. Moreover, since in the latter half of the selecting period of the line "i", the switching signal FR is at "L" level and the shift register Data are at "H" level, as shown in FIG. 4, the liquid crystal driving voltage is determined as V5.

The switching signal FR should be reversed per one screen display when it is inputted to the same line.

According to the above description, $V_{XjYi}$ is determined by a difference between signals to be outputted from the signal electrode driving circuit 2 and the scanning electrode driving circuit 3. In other words, the applied voltage ($V_{XjYi}$) to one picture element $X_j$-$Y_1$ of the display panel 1 is obtained by $V_{Yi}$-$V_{Xj}$. As a result, the applied voltage in the first half of the selecting period of the line "i" becomes $V0-V5=V_{op}-0=V_{op}$, and the applied voltage in the latter half of the selecting period of the line "i" becomes $V5-V2=0-(1-2/a)V_{op}=-(1-2/a)V_{op}$. Therefore, as shown in FIG. 1, the voltage level is changed twice per one line during one selecting period.

As mentioned above, in the above arrangement, one selecting period is divided into two, and a switching signal FR, which is reversed at the divided point of the one selecting period, is inputted to the signal electrode driving circuit 2 and the scanning electrode driving circuit 3. Moreover, a reversed signal of the data signal to be inputted during the latter half of the divided one selecting period is inputted to the signal electrode driving circuit 2 during the first half of the divided one selecting period, and the data signal to be primarily displayed is inputted thereto during the latter half of the divided one selecting period.

As a result, when the one selecting period is divided into two at its center portion and the reversed signal of the data signal to be primarily inputted during the latter half of the period is inputted during the first half of the divided period, two kinds of voltage waveforms, namely, a voltage waveform corresponding to the combination of the data signal and the switching signal FR during the first half of one selecting period and a voltage waveform corresponding to the combination of the data signal and the reversed signal of the switching signal FR during the latter half of the period can be obtained. Therefore, the level of a voltage to be applied to the liquid crystal display element can be changed twice during one selecting period.

For this reason, it is not necessary to additionally provide a signal electrode driving circuit, which is capable of changing an applied voltage at desired timing according to a control signal inputted from the outside, in order to change the applied voltage to the liquid crystal display element twice during one selecting period. Therefore, the conventional signal electrode driving circuit can be used, thereby making it possible to simplify the unit and lower its price.

The present embodiment described the case where the level of a voltage, which can be applied to one line, is changed twice during one selecting period, but the present invention is not limited to this, so even if the voltage level is changed three times or more, the same effects as those of the present embodiment can be achieved by the same arrangement.

In addition, the present embodiment described the matrix electrode structural liquid crystal display element driving unit as a matrix electrode structural display element, but the present invention is not limited to this, so it is applicable to displays adopting any methods as long as it has a matrix electrode structure.

EMBODIMENT 2

Figure 6:
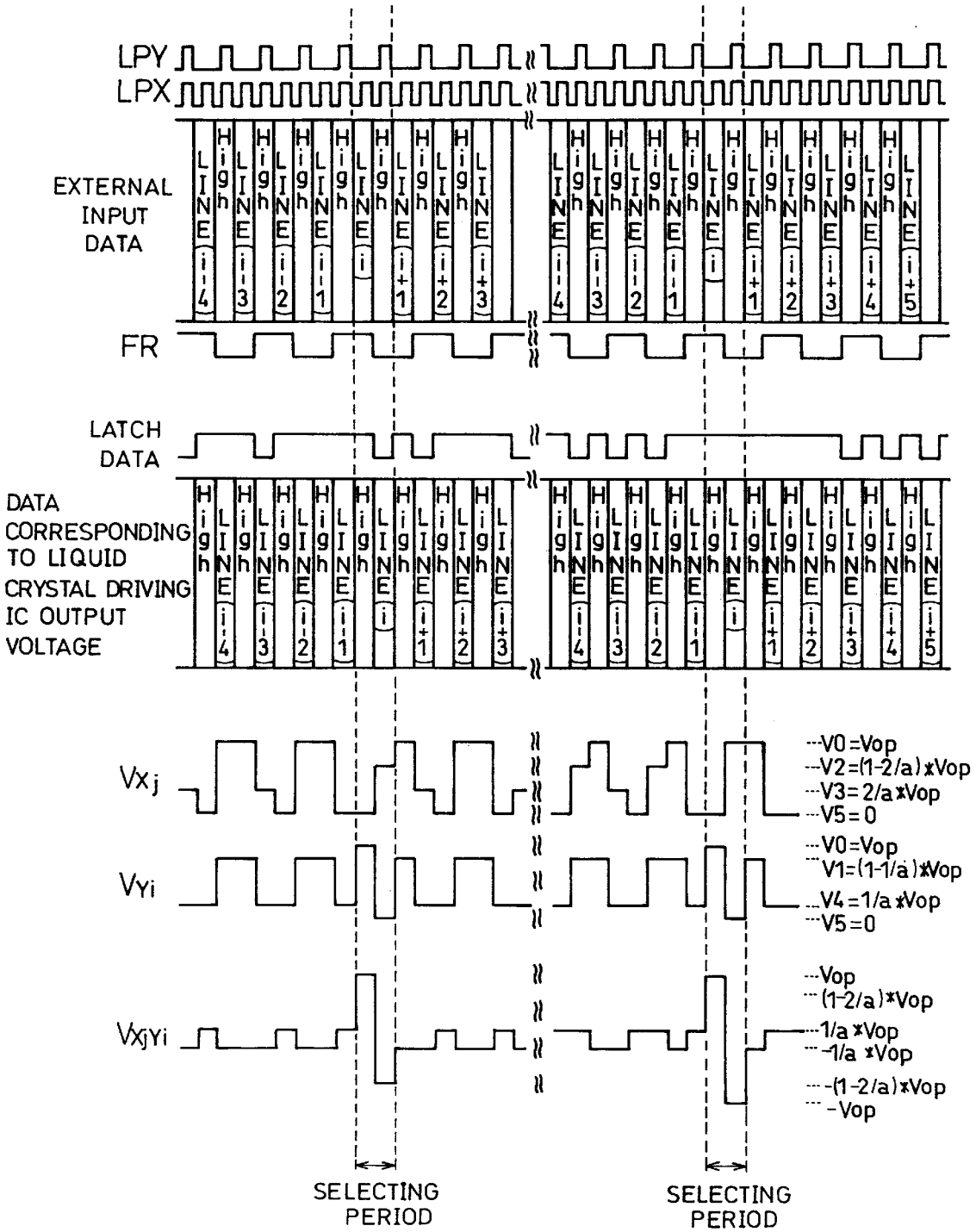
FIG. 6 is a driving timing chart in a liquid crystal display element driving unit according to another embodiment of the present invention.
Figure 7:
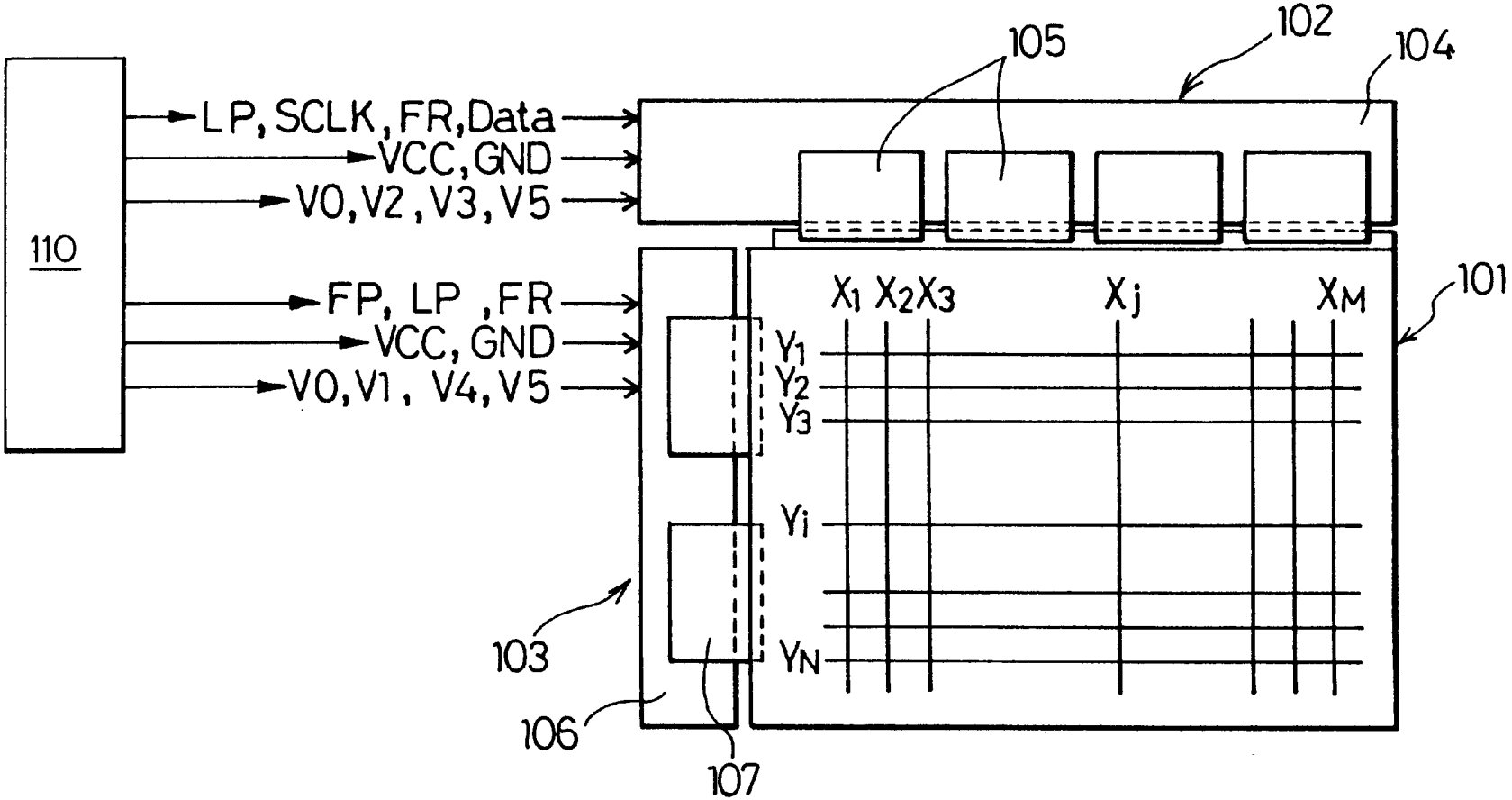
FIG. 7 is a schematic constitutional drawing of a conventional liquid crystal display element driving unit.
Figure 8:
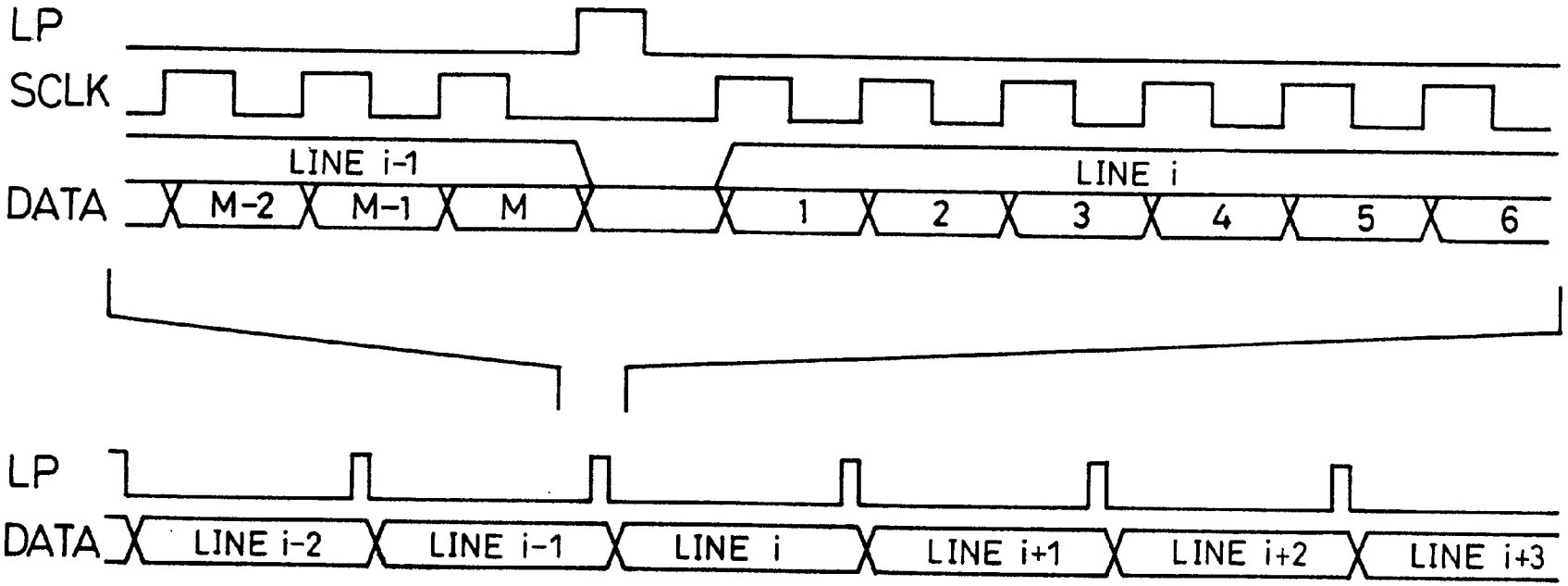
FIG. 8 is a timing chart of a control signal to be inputted to the liquid crystal display element driving unit shown in FIG. 7.
Figure 9:
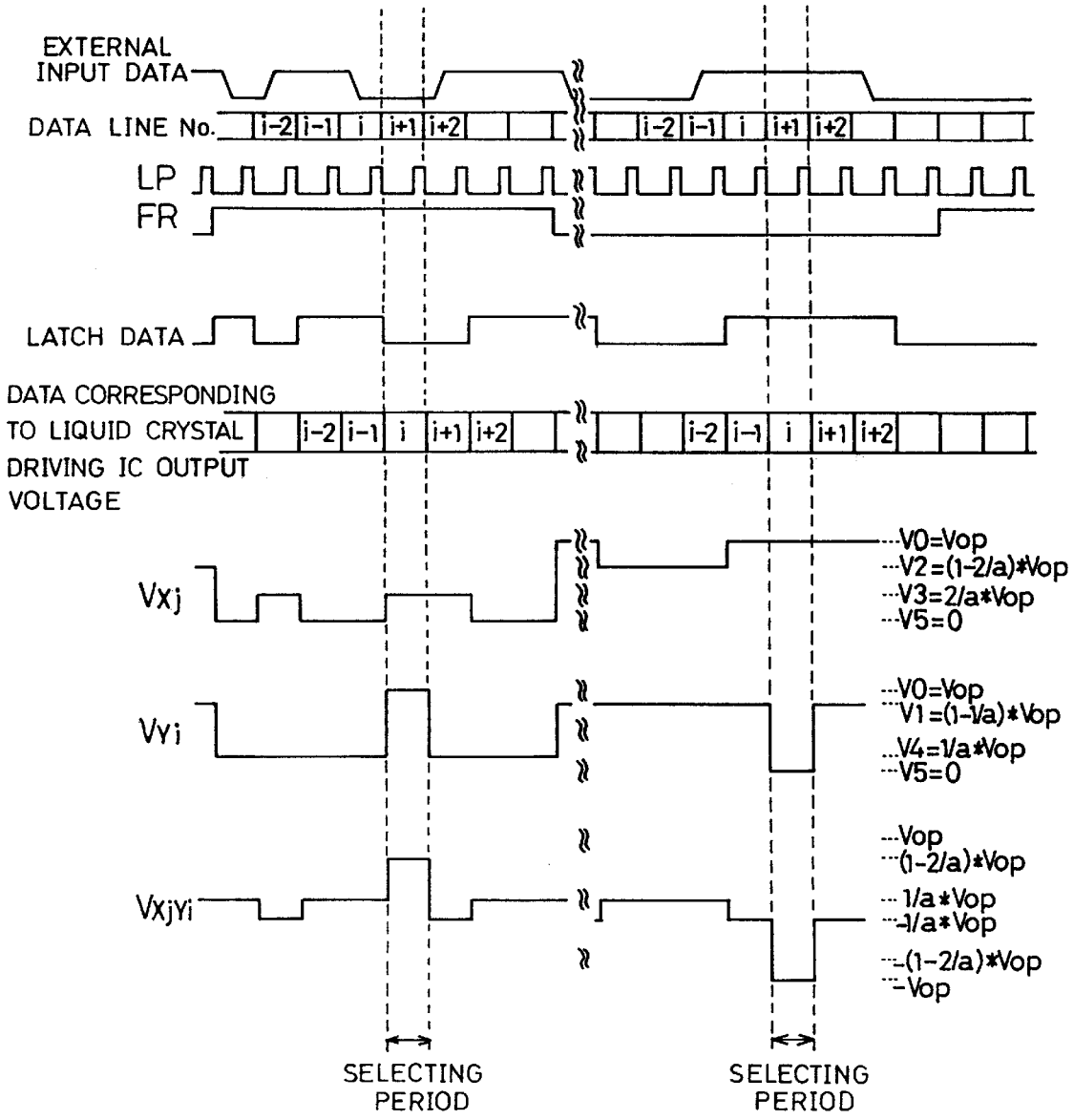
FIG. 9 is a driving timing chart in the liquid crystal display element driving unit shown in FIG. 7.

The following describes another embodiment of the present invention on reference to FIGS. 3, 4 and 6. Here, for convenience of explanation, those signals that have the same functions, and that are described in the aforementioned embodiment 1 are indicated by the same reference numerals and the description thereof is omitted.

The following describes the liquid crystal display element driving unit according to the present embodiment on reference to FIG. 6. Here, LPY, LPX and external input Data shown on the upper side of FIG. 6 are the same as LPY, LPX and data shown in FIG. 5. The external input Data show contents of data on each line, and the data contents on each line are divided into two during one selecting period. A data signal corresponding to the first half of the period is labeled "High" showing a high-level signal for "ON" period, and a signal corresponding to the latter half of the period represents a signal to be primarily inputted.

In FIG. 6, FR represents a switching signal which is reversed at a divided point of one selecting period, and latched Data represent a signal waveform of external input Data which have been latched by the latch pulse signal LPX in the signal electrode $X_j$.

$V_{Xj}$ is determined in the signal electrode side liquid crystal driving IC 5 by a combination of the switching signal FR and the latched Data. For example, on the line "HIGH" i in the first half of the selecting period of the line "i", the latched Data are at "H" level and the switching signal FR is also at "H" level, and as shown in FIG. 3, the liquid crystal driving voltage is determined as V5. Moreover, on the line "i" in the latter half of the selecting period, the latched Data are at "L" level and the switching signal FR is also at "L" level, and as shown in FIG. 3, the liquid crystal driving voltage is determined as V2.

In addition, $V_{Y1}$ is determined in the scanning electrode side liquid crystal driving IC 7 by the combination of the switching signal FR and the shift register Data. For example, on the line "High" i in the first half of the selecting period for the line i, the switching signal FR is at "H" level and the shift register Data are at "H" level, and as shown in FIG. 4, the liquid crystal driving voltage is determined as V0. Moreover, on the latter half of the selecting period for the line "i", the switching signal FR is at "L" level and the shift register Data are at "H" level, and as shown in FIG. 4, the liquid crystal driving voltage is determined as V5.

Here, the switching signal FR should be reversed per one screen display when it is inputted to the same line.

According to the above, $V_{XiYj}$ is determined by a difference between the signals outputted from the signal electrode driving circuit 2 and the scanning electrode driving circuit 3. In other words, the applied voltage to one picture element Xj-Yi of the display panel 1 is obtained by $V_{Yi}$-$V_{Xj}$. As a result, the applied voltage in the first half of the selecting period for the line "i" becomes $V0-V5=V_{op}-0=V_{op}$, and the applied voltage in the latter half of the selecting period for the line "i" becomes $V5-V2=0-(1-2/a)V_{op}=-(1-2/a)V_{op}$. Therefore, as shown in FIG. 6, the voltage level is changed twice per one line during one selecting period.

As described above, in the above arrangement, one selecting period is divided into two, and the switching signal FR, which is reversed at the divided point of one selecting period, is inputted to the signal electrode driving circuit 2 and the scanning electrode driving circuit 3. Moreover, high-level data signal is inputted to the signal electrode driving circuit 2 during the first half of the divided one selecting period, and a data signal to be primarily displayed is inputted thereto during the latter half of the divided one selecting period.

As a result, if a voltage level is changed twice during one selecting period, the switching signal FR is reversed at timing that the data signal is divided in one selecting period, and the high-level data signal during the first half of divided one selecting period and the data signal to be primarily displayed during the latter half of divided one selecting period are inputted to the signal electrode driving circuit 2. As a result, one selecting period is divided into two at its center portion, and during the first half of the period, a waveform of a voltage corresponding to an "ON' signal, for example, as the high-level signal can be obtained.

For this reason, it is not necessary to additionally provide a signal electrode driving circuit, which is capable of changing an applied voltage at desired timing according to a control signal inputted from the outside, in order to change the applied voltage to the liquid crystal display element twice during one selecting period. Therefore, the conventional signal electrode driving circuit can be used, thereby making it possible to simplify the unit and lower its price.

As mentioned above, in embodiment 2, for convenience of explanation, the output voltage level from each liquid crystal driving IC fulfil a relationship "V0>V1>V2>V3>V4>V5", but the voltage level is not limited to this, so each voltage level V0, V1, V2, F3, V4 and V5 can be changed on the outside.

Embodiment 2 explains the example that the level of a voltage to be applied to the liquid crystal display element is changed twice during one selecting period, but the example is not limited to this, so the applied voltage level can be changed three times or more.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A matrix electrode structural display element driving unit which applies a voltage difference between voltages from a signal electrode group and a scanning electrode group, which are arranged in a matrix pattern, to a matrix electrode structural display element according to a data signal so as to drive the matrix electrode structural display element, and combines a signal electrode driving circuit with a scanning electrode driving circuit so as to change a level of the voltage to be applied to the matrix electrode structural display element twice or more during a fixed one selecting period, said matrix electrode structural display element driving unit comprising:

a signal electrode driving circuit for selecting one voltage from four voltages according to the data signal and a switching signal which is reversed at a divided point at which the one selecting period is divided into two so as to apply the voltage as a signal electrode voltage to each signal electrode, said signal electrode driving circuit using a reversed signal of the data signal for selecting the voltage during the first half of the one selecting period, and using the data signal for selecting the voltage during the latter half of the one selecting period; and a scanning electrode driving circuit for selecting one voltage from two voltages for selection according to the switching signal and a selection signal, which represents which line should be selected, so as to apply the voltage to the scanning electrode, which corresponds to the selected line and for selecting one voltage of two voltages for a non-selected line so as to apply the voltage as a scanning electrode voltage to the scanning electrodes which corresponds to the non-selected line.

2. The matrix electrode structural display element driving unit as defined in claim 1, wherein said matrix electrode structural display element is a liquid crystal display element.

3. The matrix electrode structural display element driving unit which applies a voltage difference between voltages from a signal electrode group and a scanning electrode group, which are arranged in a matrix pattern, to a matrix electrode structural display element according to a data signal so as to drive the matrix electrode structural display element, and combines a signal electrode driving circuit with a scanning electrode driving circuit so as to change a level of the voltage to be applied to the matrix electrode structural display element twice or more during a fixed one selecting period, said matrix electrode structural display element driving unit comprising:

a signal electrode driving circuit for selecting one voltage from four voltages according to the data signal and a switching signal so as to apply the voltage as a signal electrode voltage to each signal electrode;

a scanning electrode driving circuit for selecting one voltage from two voltages for selection according to the switching signal and a selection signal, which represents which line should be selected, so as to apply the voltage to the scanning electrode, which corresponds to the selected line and for selecting one voltage of two voltages for a non-selected line so as to apply the voltage as a scanning electrode voltage to the scanning electrodes which corresponds to the non-selected line; and a control section for:

outputting the switching signal FR to said signal electrode driving circuit and said scanning electrode driving circuit, outputting a latch pulse signal LPY, which defines timing of selecting a line, to said scanning electrode driving circuit, outputting a latch pulse signal LPX, which defines a timing of reversing the switching signal FR, to said signal electrode driving circuit, outputting a shift clock signal SCLK, which defines a timing of taking out data for selection of the voltage from the data signal, to said signal electrode driving circuit, and outputting a frame pulse signal FP, which defines a timing of starting display for new one screen display by showing selecting timing of the first line on display on the screen, to said scanning electrode driving circuit.

4. The matrix electrode structural display element driving unit as defined in claim 3, wherein said signal electrode driving circuit latches the data signal using the latch pulse signal LPX so as to create latched Data which are used as the data signal for selecting the voltage.

5. The matrix electrode structural display element driving unit as defined in claim 3, wherein said scanning electrode driving circuit creates shift register Data as the selection signal using the frame pulse signal FP and the latch pulse signal LPY.

6. The matrix electrode structural display element driving unit as defined in claim 5, wherein said scanning electrode driving circuit creates the shift register Data composed of shift register Data only on the first line being "High" and shift register Data on the other lines being "Low" at a timing that the latch pulse signal LPY is changed from "High" to "Low" when the frame pulse signal FP is "High", and creates the shift register Data, which are composed of shift register Data only on a next line to a line where the shift register Data are high before the latch pulse signal LPY is changed from "High" to "Low" and shift register Data on the other lines being Low, at a timing that the latch pulse signal LPY is changed from "High" to "Low" when the frame pulse signal FP is "Low".

7. The matrix electrode structural display element driving unit as defined in claim 3, wherein said matrix electrode structural display element is a liquid crystal display element.

8. The matrix electrode structural display element driving unit which applies a voltage difference between voltages from a signal electrode group and a scanning electrode group, which are arranged in a matrix pattern, to a matrix electrode structural display element according to a data signal so as to drive the matrix electrode structural display element, and combines a signal electrode driving circuit with a scanning electrode driving circuit so as to change a level of the voltage to be applied to the matrix electrode structural display element twice or more during a fixed one selecting period, said matrix electrode structural display element driving unit comprising:

a signal electrode driving circuit for selecting one voltage from four voltages according to the data signal and a switching signal which is reversed at a divided point at which the one selecting period is divided into two so as to apply the voltage as a signal electrode voltage to each signal electrode, said signal electrode driving circuit using a high-level signal as the data signal for selecting the voltage during a first period of the selecting period, and using the data signal directly for selecting the voltage during the remaining period of the selecting period; and a scanning electrode driving circuit for selecting one voltage from two voltages for selection according to the switching signal and a selection signal, which represents which line should be selected, so as to apply the voltage to the scanning electrode, which corresponds to the selected line and for selecting one voltage of two voltages for a non-selected line so as to apply the voltage as a scanning electrode voltage to the scanning electrodes which corresponds to the non-selected line.

9. The matrix electrode structural display element driving unit as defined in claim 8, wherein said matrix electrode structural display element is a liquid crystal display element.

* * * * *